US006036623A

United States Patent [19]

Mitchell

[11] Patent Number: 6,036,623

[45] Date of Patent: Mar. 14, 2000

[54] COLLAPSIBLE MACHINE FOR EXERCISING THE WHOLE BODY OF AN EXERCISER IN A WHEELCHAIR

[76] Inventor: John R. Mitchell, 19352 Seminole Cir., Bend, Oreg. 97702

[21] Appl. No.: 09/003,229

[22] Filed: Jan. 6, 1998

[51] Int. Cl.[7] ..... A63B 21/00

[52] U.S. Cl. ..... 482/57

[58] Field of Search ..... 482/51, 52, 57, 482/64, 904, 62, 906

[56] References Cited

U.S. PATENT DOCUMENTS

| | | | |
|---|---|---|---|
| 2,735,422 | 2/1956 | Jones | 482/904 |
| 4,402,502 | 9/1983 | Peters | 482/62 |
| 4,911,425 | 3/1990 | Kynast et al. | 482/904 |
| 5,048,827 | 9/1991 | Caruso | 482/904 |
| 5,256,117 | 10/1993 | Potts et al. | 482/52 |
| 5,261,865 | 11/1993 | Trainor | 482/904 |
| 5,330,402 | 7/1994 | Johnson | 482/62 |
| 5,343,856 | 9/1994 | Proctor | 601/35 |
| 5,378,209 | 1/1995 | Kendrew | 482/52 |

*Primary Examiner*—Stephen R. Crow
*Attorney, Agent, or Firm*—Robert E. Howard

[57] ABSTRACT

A collapsible machine for exercising the whole body of an exerciser in a wheelchair having wheels that includes a base, a frame, a drive train, lower pivoting apparatus, and upper pivoting apparatus. The base is placed on a generally horizontal surface, the frame is pivotally mounted to the base. The drive train is rotatively mounted to the frame, the lower pivoting apparatus pivotally mounts the frame to the base. The upper pivoting apparatus pivotally mounts portions of the frame to each other.

37 Claims, 3 Drawing Sheets

COLLAPSIBLE MACHINE FOR EXERCISING THE WHOLE BODY OF AN EXERCISER IN A WHEELCHAIR

BACKGROUND OF THE INVENTION

1. Field of the Invention

The present invention relates to an exercise machine. More particularly, the present invention relates to a collapsible machine for exercising the whole body of an exerciser in a wheelchair.

2. Description of the Prior Art

Numerous innovations for exercise machines have been provided in the prior art that will be described. Even though these innovations may be suitable for the specific individual purposes to which they address, however, they differ from the present invention.

FOR EXAMPLE, U.S. Pat. No. 3,256,117 to Potts et al. teaches an apparatus for simultaneous upper body exercise and lower body exercise. The lower body exercise is of a stair-climbing simulation type. Movement of the upper body exercise handle and lower body exercise pedals are independent from one another. Resistance to motion of the handles and pedals is provided and controlled so as to produce substantially isokinetic exercise. Step-down gears are provided so that a similar amount of upper body effort and lower body effort is perceived by the exerciser.

ANOTHER EXAMPLE, U.S. Pat. No. 5,330,402 to Johnson teaches an exercising device wherein a rotary crank handle mechanism is mounted on the upper end portion of a frame assembly for exercising the upper body portion of a person, and an exercising mechanism is mounted on the lower portion of the frame assembly for exercising the lower body portion of the person. The upper and lower exercising mechanisms are independently operable from each other, and the upper crank handle mechanism is provided with a plurality of adjustment features so that the mechanism can be pivoted to a desired position relative to the frame assembly and the crank arms can be oriented relative to each other to recreate the effects of swimming or rowing.

STILL ANOTHER EXAMPLE, U.S. Pat. No. 5,343,856 to Proctor teaches a complete body passive exercise machine. A motor drives a crank shaft which rotates two foot plates about a given point. These foot plates are attached to limited slide joint assemblies which cause the foot plates to flex forwardly and rearwardly while they are being moved in a circle thereby exercising the legs and ankles. The crankshaft is also operatively attached to arm levers which are held onto by the user. The arm levers work such that the one of the user's arms is fully extended while the other is close to the user's body thereby working the arms as well as pivoting the torso.

FINALLY, YET ANOTHER EXAMPLE, U.S. Pat. No. 5,378,209 to Kendrew teaches an apparatus to exercise the arms and legs in which the user stands upright on foot levers which are supported by a downward pull or a push exerted on hand levers to which the foot levers are independently connected so that the arms and legs move in opposition to each other in substantially upward and downward directions enabling a variety of pull-up, push-up, and stepping or climbing exercises to be performed without the need for either weights, friction, or damping devices, and which apparatus can be constructed simply and inexpensively using off the shelf hardware components.

It is apparent that numerous innovations for exercise machines have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a collapsible machine for exercising the whole body of an exerciser in a wheelchair that avoids the disadvantages of the prior art.

ANOTHER OBJECT of the present invention is to provide a collapsible machine for exercising the whole body of an exerciser in a wheelchair that is simple and inexpensive to manufacture.

STILL ANOTHER OBJECT of the present invention is to provide a collapsible machine for exercising the whole body of an exerciser in a wheelchair that is simple to use.

BRIEFLY STATED, YET ANOTHER OBJECT of the present invention is to provide a collapsible machine for exercising the whole body of an exerciser in a wheelchair having wheels that includes a base, a frame, a drive train, lower pivoting apparatus, and upper pivoting apparatus. The base is placed on a generally horizontal surface, the frame is pivotally mounted to the base. The drive train is rotatively mounted to the frame, the lower pivoting apparatus pivotally mounts the frame to the base. The upper pivoting apparatus pivotally mounts portions of the frame to each other.

The novel features which are considered characteristic of the present invention are set forth in the appended claims. The invention itself, however, both as to its construction and its method of operation, together with additional objects and advantages thereof, will be best understood from the following description or the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
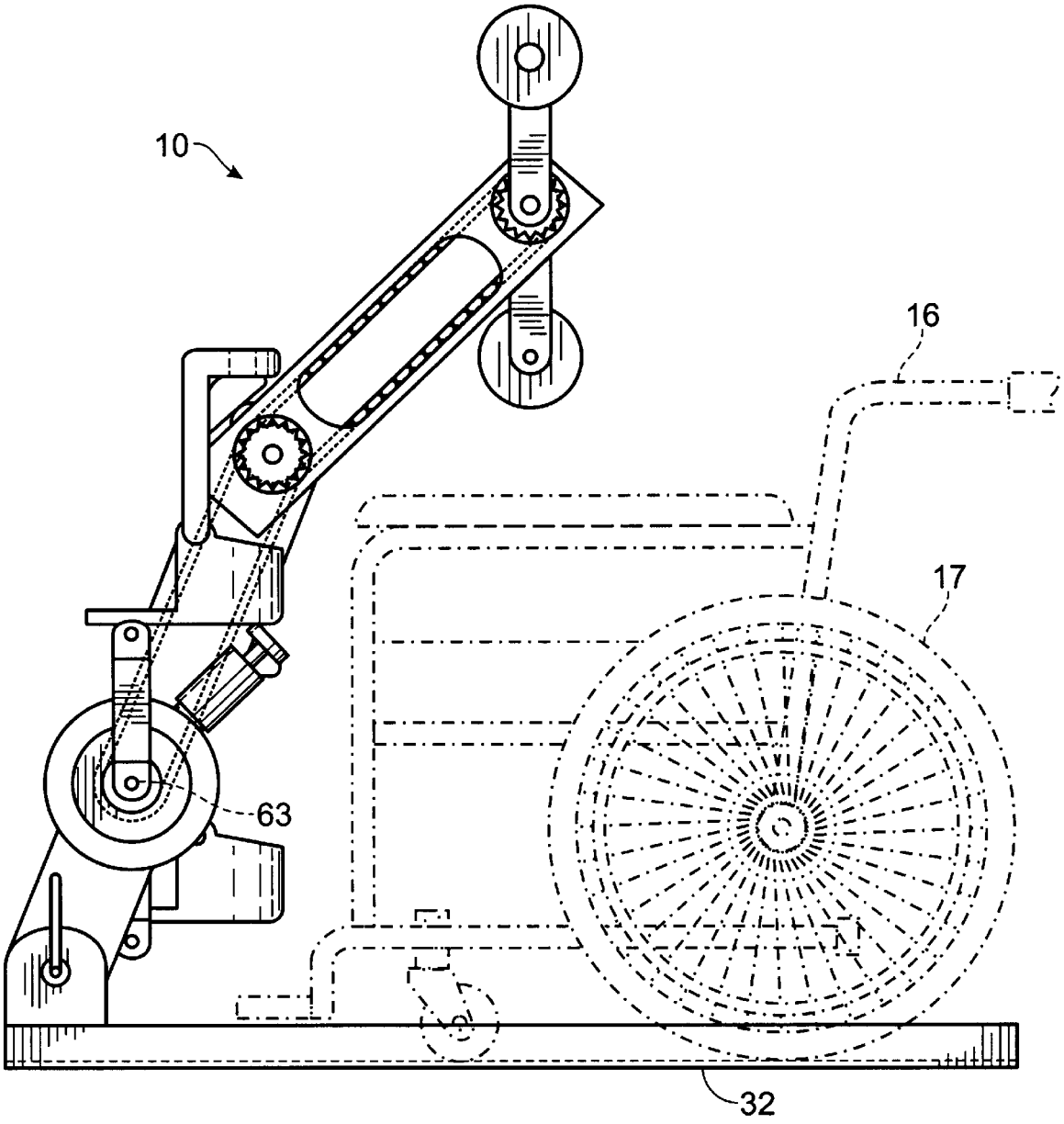
FIG. 1 is a diagrammatic side elevational view of the present invention with an exerciser sitting in a wheelchair shown in phantom and exercising.

| | |
|---|---|
| 10 | collapsible machine for exercising the whole body of an exerciser in a wheelchair of the present invention |
| 16 | wheelchair |
| 17 | wheels of wheelchair 16 |
| 18 | base for placement on a generally horizontal surface 20 |
| 20 | horizontal surface |

-continued 22 frame pivotally mounted to base 18
24 drive train rotatively mounted to frame 22
26 lower pivoting apparatus pivotally mounting frame 22 to base 18
28 upper pivoting apparatus pivotally mounting portions of frame 18 to each other
30 body of base 18
32 lowermost surface of body 30 of base 18 for positioning on generally horizontal surface 20
34 uppermost surface of body 30 of base 18
36 front edge of body 30 of base 18
38 pair of legs of body 30 of base 18
40 pair of outer longitudinal sides defining pair of legs 38 of body 30 of base 18
42 pair of inner longitudinal sides further defining pair of legs 38 of body 30 of base 18
44 pair of rearmost edges further defining pair of legs 38 of body 30 of base 18
46 approximate midpoints of pair of legs 38 of body 30 of base 18
48 front cross member of base 18
50 pair of rear cross members of base 18
52 pair of inner side rails of base 18
54 pair of outer side rails of base 18
56 hinge of each side rail of pair of outer side rails 54 of base 18
58 guide ramps 58 for properly positioning wheels 17 of wheelchair 16
60 lower arm of frame 22
61 approximate midpoint of lower arm 60 of frame 22
62 lowermost end of lower arm 60 of frame 22
63 throughbore extending laterally through approximate midpoint of lower arm 60 of frame 22
64 uppermost end of lower arm 60 of frame 22
65 throughbore extending laterally through uppermost end 64 of lower arm 60 of frame 22
66 upper arm of frame 22
68 lowermost end of upper arm 66 of frame 22
69 throughbore extending laterally through lowermost end 68 of upper arm 66 of frame 22
70 uppermost end of upper arm 66 of frame 22
71 throughbore extending laterally through uppermost end 70 of upper arm 66 of frame 22
72 upper crankshaft of drive train 24
73 lowermost free end of lowermost end 68 of upper arm 66 of frame 22
74 upper crank axle of upper crankshaft 72 of drive train 24
76 upper sprocket gear of upper crankshaft 72 of drive train 24
78 pair of upper crank arms of upper crankshaft 72 of drive train 24
80 intermediate axle of drive train 24
82 pair of intermediate sprocket gears of drive train 24
84 lower crankshaft of drive train 24
86 lower crank axle of lower crankshaft 84 of drive train 24
88 lower sprocket gear of lower crankshaft 84 of drive train 24
90 pair of lower crank arms of lower crankshaft 84 of drive train 24
92 pair of flywheels of lower crankshaft 84 of drive train 24
94 upper sprocket chain of drive train 24
96 lower sprocket chain of drive train 24
97 pair of foot pedals of drive train 24
98 rear portion of each pedal of pair of foot pedals 97 of drive train 24 for supporting a lower leg of exerciser
99 bottom portion of each pedal of pair of foot pedals 97 of drive train 24 for supporting a foot of exerciser
100 tensioner of drive train 24
102 block of tensioner 100 of drive train 24
104 threaded bolt of tensioner 100 of drive train 24
105 throughbore extending laterally through lowermost end 62 of lower arm 60 of frame 22
106 head of threaded bolt 104 of tensioner 100 of drive train 24
107 pair of pivot plates of lower pivoting apparatus 26
108 throughbores extending laterally aligned through pair of pivot plates 107 of lower pivoting apparatus 26
110 threaded bolt of lower pivoting apparatus 26
111 threaded throughbore in handle 112 of lower pivoting apparatus 26
112 handle of lower pivoting apparatus 26
114 throughslot in both sides of lowermost end 68 of upper arm 66 of frame 22
115 another throughbore in lowermost end 68 of upper arm 66 of frame 22
116 hub of upper pivoting apparatus 28
118 threaded bolt of upper pivoting apparatus 28

-continued 120 threaded throughbore in handle 122 of upper pivoting apparatus 28
122 handle of upper pivoting apparatus 28

DETAILED DESCRIPTION OF THE PREFERRED EMBODIMENT

Referring now to the figures in which like numerals indicate like parts, and particularly to FIG. 1, the collapsible machine for exercising the whole body of an exerciser in a wheelchair of the present invention is shown generally at 10 for exercising the whole body of an exerciser in a wheelchair 16 that has wheels 17.

Figure 2:
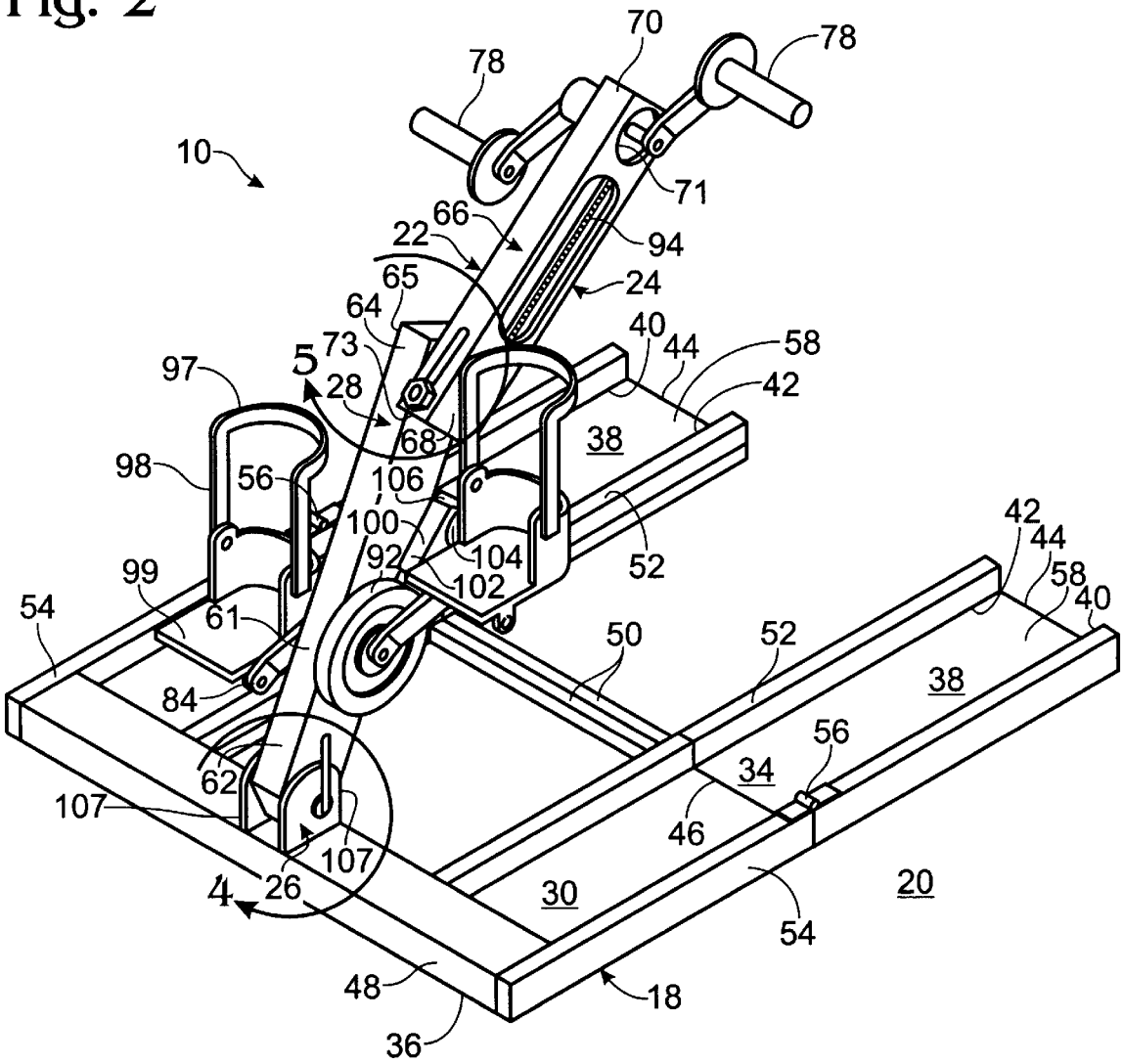
FIG. 2 is a diagrammatic perspective view of just the present invention per se.

The overall configuration of the collapsible machine for exercising the whole body of an exerciser in a wheelchair 10 can best be seen in FIG. 2, and as such will be discussed with reference thereto.

The collapsible machine for exercising the whole body of an exerciser in a wheelchair 10 comprises a base 18 for placement on a generally horizontal surface 20 and a frame 22 that is pivotally mounted to the base 18.

The collapsible machine for exercising the whole body of an exerciser in a wheelchair 10 further comprises a drive train 24 that is rotatively mounted to the frame 22, lower pivoting apparatus 26 that pivotally mounts the frame 22 to the base 18, and upper pivoting apparatus 28 that pivotally mounts portions of the frame 18 to each other.

The specific configuration of the base 18 can best be seen in FIG. 2, and as such will be discussed with reference thereto.

The base 18 comprises a body 30 that is flat, thin, substantially U-shaped, and opens rearwardly. The body 30 of the base 18 has a lowermost surface 32 for placement on the generally horizontal surface 20, an uppermost surface 34 that is disclosed above, and parallel to, the lowermost surface 32 of the body 30 of the base 18, a front edge 36, and a pair of legs 38.

The pair of legs 38 of the body 30 of the base 18 are formed by a pair of outer longitudinal sides 40 that are parallel and spaced-apart, a pair of inner longitudinal sides 42 that are spaced-apart and parallel to each other and to, and inward of, the pair of outer longitudinal sides 40 of the pair of legs 38 of the body 30 of the base 18, and a pair of rearmost edges 44 that are collinear, spaced-apart, parallel to, and rearward of, the forwardmost edge 36 of the body 30 of the base 18.

The pair of legs 38 of the body 30 of the base 18 are divided laterally, at their approximate midpoints 46, so as to allow the base 18 to fold for easy storage and transport.

The base 18 further comprises a front cross member 48 that is disposed on the uppermost surface 34 of the body 30 of the base 18, and extends laterally along the forwardmost edge 36 of the body 30 of the base 18 so as to add rigidity thereto.

The base 18 further comprises a pair of rear cross members that are square tubing and abut each other laterally, and extend laterally from one leg of the pair of legs 38 of the body 30 of the base 18 to the other leg of the pair of legs 38 of the body 30 of the base 18, at the pair of inner longitudinal sides 42 of the pair of legs 38 of the body 30 of the base 18 so as to add further rigidity thereto, with a forwardmost one thereof being forward of the approximate midpoints 46 of the pair of legs 38 of the body 30 of the base 18, and with a rearmost one thereof being rearward of the approximate midpoints 46 of the pair of legs 38 of the body 30 of the base 18 so as not to interfere with the base 18 when it folds.

The base 18 further comprises a pair of inner side rails, 52 that are square tubing and disposed on the uppermost surface 34 of the body 30 of the base 18, extend longitudinally along the pair of inner longitudinal sides 42 of the pair of legs 38 of the body 30 of the base 18, along their entire lengths, so as to add further rigidity thereto, and are divided laterally, at the approximate midpoints 46 of the pair of legs 38 of the body 30 of the base 18, so as not to interfere with the base 18 when it folds.

The base 18 further comprises a pair of outer side rails 54 that are disposed on the uppermost surface 34 of the body 30 of the base 18, extend longitudinally along the pair of outer longitudinal sides 40 of the pair of legs 38 of the body 30 of the base 18, along their entire length, so as to add further rigidity thereto, and are divided laterally, at the approximate midpoints 46 of the pair of legs 38 of the body 30 of the base 18, so as not to interfere with the base 18 when it folds.

Each side rail of the pair of outer side rails 54 of the base 18 is hingedly attached, at its division, by a hinge 56 on its uppermost surface so as to allow the base 18 to fold upwardly, yet be rigid when unfolded.

The pair of legs 38 of the body 30 of the base 18, the pair of inner side rails 52 of the base 18, and the pair of outer side rails 54 of the base 18 form guide ramps 58 for properly positioning the wheels 17 of the wheelchair 16.

The specific configuration of the frame 22 can best be seen in FIG. 2, and as such will be discussed with reference thereto.

The frame 22 comprises a lower arm 60 that is hollow and rectangular-parallelepiped-shaped, and has an approximate midpoint 61 with a throughbore 63 extending laterally therethrough, a lowermost end 62 that is pivotally mounted to the uppermost surface 34 of the body 30 of the base 18, on the front cross member 48 of the base 18, at its midpoint, and a uppermost end 64 with a throughbore 65 extending laterally therethrough.

The frame 22 further comprises an upper arm 66 that is hollow and rectangular-parallelepiped-shaped, and has a lowermost end 68 with a throughbore 69 extending laterally therethrough and a lowermost free end 73. The lowermost end 68 of the upper arm 66 of the frame 22 is pivotally mounted, side by side, to the uppermost end 64 of the lower arm 60 of the frame 22 so as to fold relative thereto, and further has an uppermost end 70 with a throughbore 71 extending laterally therethrough.

Figure 3:
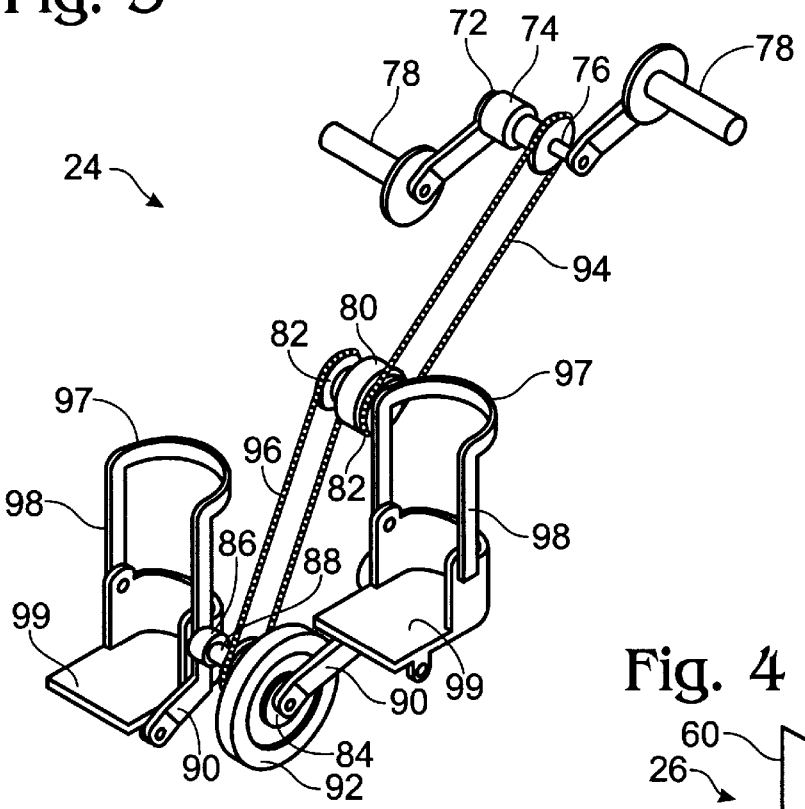
FIG. 3 is a diagrammatic perspective view of just the drive train per se of the present invention.
Figure 4:
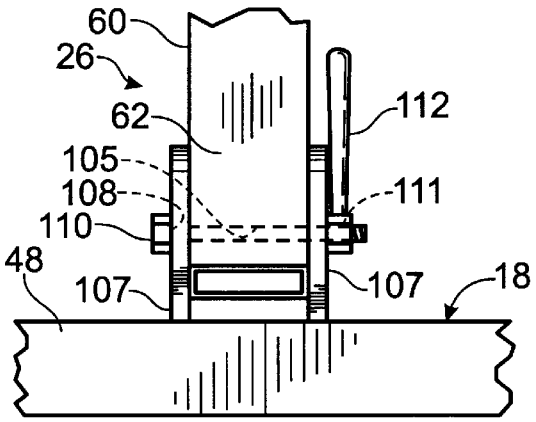
FIG. 4 is an enlarged diagrammatic side elevational view of the area generally enclosed by the dotted ellipse identified by arrow 4 in FIG. 2.

The specific configuration of the drive train 24 can best be seen in FIGS. 2 and 3, and as such will be discussed with reference thereto.

The drive train 24 comprises an upper crankshaft 72 that comprises an upper crank axle 74 that extends rotatably through the throughbore 71 in the uppermost end 70 of the upper arm 66 of the frame 22 for rotative motion relative thereto.

The upper crankshaft 72 of the drive train 24 further comprises an upper sprocket gear 76 that is disposed in the upper arm 66 of the frame 22, and is mounted on the upper crank axle 74 of the upper crankshaft 72 of the drive train 24 for rotation therewith.

The upper crankshaft 72 of the drive train 24 further comprises a pair of upper crank arms 78 that are offsetingly disposed on the upper crank axle 74 of the upper crankshaft 72 of the drive train 24, at its ends, for rotation therewith and for gripping by the hands of the exerciser.

The drive train 24 further comprises an intermediate axle 80 that extends rotatably through the throughbore 65 in the uppermost end 64 of the lower arm 60 of the frame 22 and rotatably through the throughbore 69 in the lowermost end 68 of the upper arm 66 of the frame 22.

The drive train 24 further comprises a pair of intermediate sprocket gears 82 that are mounted on the intermediate axle 80 of the drive train 24 for rotation therewith, with one gear thereof disposed in the uppermost end 64 of the lower arm 60 of the frame 22, and with the other gear thereof disposed in the lowermost end 68 of the upper arm 66 of the frame 22.

The drive train 24 further comprises a lower crankshaft 84 that comprises a lower crank axle 86 that extends rotatably through the throughbore 63 in the approximate midpoint 61 of the lower arm 60 of the frame 22 for rotation relative thereto.

The lower crankshaft 84 of the drive train 24 further comprises a lower sprocket gear 88 that is disposed in the lower arm 60 of the frame 22, and is mounted on the lower crank axle 86 of the lower crankshaft 84 of the drive train 24 for rotation therewith.

The lower crankshaft 84 of the drive train 24 further comprises a pair of lower crank arms 90 that are offsetingly disposed on the lower crank axle 86 of the lower crankshaft 84 of the drive train 24, at its ends, for rotation therewith.

The lower crankshaft 84 of the drive train 24 further comprises a pair of flywheels 92 that are disposed on the lower crank axle 86 of the lower crankshaft 84 of the drive train 24 for rotation therewith, between the lower arm 60 of the frame 22 and the pair of lower crank arms 90 of the lower crankshaft 84 of the drive train 24 or adding momentum.

The drive train 24 further comprises an upper sprocket chain 94 that is disposed in the upper arm 66 of the frame 22, and engages the upper sprocket gear 76 of the upper crankshaft 72 of the drive train 24 and engages the other sprocket gear of the pair of intermediate sprocket gears 82 of the drive train 24 for rotation therewith.

The drive train 24 further comprises a lower sprocket chain 96 that is disposed in the lower arm 60 of the frame 22, and engages the one sprocket gear of the pair of intermediate sprocket gears 82 of the drive train 24 and engages the lower sprocket gear 88 of the lower crankshaft 84 of the drive train 24 for rotation therewith so as to allow one crankshaft to rotate when the other crankshaft is rotated allowing the collapsible machine for exercising the whole body of an exerciser in a wheelchair 10 to be used be the exerciser with use of either only their arms or legs.

The drive train 24 further comprises a pair of foot pedals 97 that are substantially L-shaped in vertical profile so as to prevent the ankles of the exerciser from unwanted movement when the legs of the exerciser lack the ability to act.

Each pedal of the pair of foot pedals 97 of the drive train 24 comprises a bottom portion 99 for supporting a foot of the exerciser, and is flat and pivotally mounted to a respective arm of the pair of lower crank arms 90 of the lower crankshaft 84 of the drive train 24.

Each pedal of the pair of foot pedals 97 of the drive train 24 further comprises a rear portion 98 for supporting a lower leg of the exerciser, and is substantially semi-cylindrically-shaped and extends upwardly from the bottom portion 99 of a respective pedal of the pair of foot pedals 97 of the drive train 24, at its rear edge.

The drive train 24 further comprises a tensioner 100 for adjusting resistance on the lower crankshaft 84, and is disposed on the lower arm 60 of the frame 22, on one side thereof, and at its approximate midpoint 61.

The tensioner 100 of the drive train 24 comprises a block 102 that is internally threaded and fixedly attached to the midpoint 61 of the one side of the lower arm 60 of the frame 22, and extends longitudinally therealong.

The tensioner 100 of the drive train 24 further comprising a threaded bolt 104 that threadably engages through the block 102 of the tensioner 100 of the drive train 24, with its free end being in selective contact with one flywheel of the pair of flywheels 93 of the drive train 24, and with its head 106 providing a gripping surface for its rotation.

Figure 5:
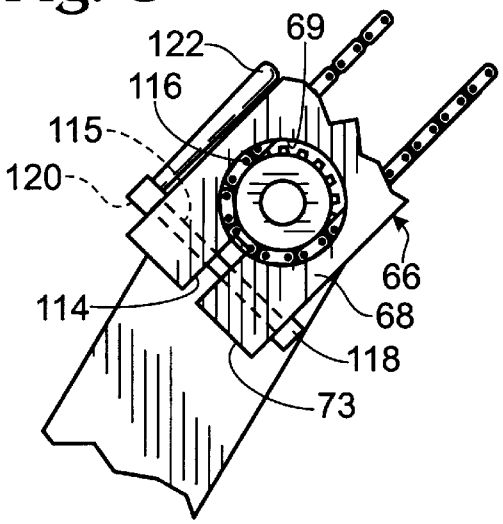
FIG. 5 is an enlarged diagrammatic side elevational view of the area generally enclosed by the dotted ellipse identified by arrow 5 in FIG. 2.

The specific configuration of the lower pivoting apparatus 26 can best be seen in FIGS. 2 and 5, and as such will be discussed with reference thereto.

The lower pivoting apparatus 26 comprises a throughbore 105 that extends laterally through the lowermost end 62 of the lower arm 60 of the frame 22.

The lower pivoting apparatus 26 further comprises a pair of pivot plates 107 that are flat, spaced-apart, parallel, and have throughbores 108 extending laterally aligned therethrough. The pair of pivot plates 107 of the lower pivoting apparatus 26 extend perpendicularly upwardly from the uppermost surface 34 of the body 30 of the base 18, on the front cross member 48 of the base 18, at its midpoint, and straddle the lowermost end 62 of the lower arm 60 of the frame 22.

The lower pivoting apparatus 26 further comprises a threaded bolt 110 that extends through the throughbores 108 in the pair of pivot plates 107 of the lower pivoting apparatus 26, through the throughbore 105 in the lowermost end 62 of the lower arm 60 of the frame 22, and threadably engages a threaded throughbore 111 in a handle 112 so by tightening the handle 112 of the lower pivoting apparatus 26, the pair of pivot plates 107 compress against the lowermost end 62 of the lower arm 60 of the frame 22 and maintain it in its desired position, and by loosening the handle 112 of the lower pivoting apparatus 26, the pair of pivot plates 107 release from the lowermost end 62 of the lower area 63 of the frame 22 and allow it to pivot to its desired position.

The configuration of the upper pivoting apparatus 28 can best be seen in FIGS. 2 and 5, and as such will be discussed with reference thereto.

The upper pivoting apparatus 28 comprises the lowermost end 68 of the upper arm 66 of the frame 22 having a throughslot 114 that extends axially from the throughbore 69 in the lowermost end 68 of the upper arm 66 of the frame 22 to the lowermost free end 73 of the lowermost end 68 of the lower arm 66 of the frame 22, on both sides of the lowermost end 68 of the lower arm 66 of the frame 22.

The upper pivoting apparatus 28 further comprises the lowermost end 68 of the upper arm 66 of the frame 22 having another throughbore 115 that extends therethrough, from front to back.

The upper pivoting apparatus 28 further comprises a hub 116 that extends pivotally through the throughbore 69 in the lowermost end 68 of the upper arm 66 of the frame 22 and fixedly through the throughbore 65 in the uppermost end 64 of the lower arm 60 of the frame 22 for pivoting therewith.

The upper pivoting apparatus 28 further comprises a threaded bolt 118 that extends through the another throughbore 115 in the lowermost end 68 of the upper arm 66 of the frame 22 and threadably engages a threaded throughbore 120 in a handle 122 so by tightening the handle 122 of the upper pivoting apparatus 28, the throughslot 114 in both sides of the lowermost end 68 of the upper arm 66 of the frame 22 compress causing the throughbore 69 in the lowermost end 68 of the upper arm 66 of the frame 22 to compress against the hub 116 of the upper pivoting apparatus 28 and maintain the upper arm 66 of the frame 22 in its desired position, and by loosening the handle 122 of the upper pivoting apparatus 28, the throughslot 114 in both sides of the lowermost end 68 of the upper arm 66 of the frame 22 open causing the throughbore 69 in the lowermost end 68 of the upper arm 66 of the frame 22 to release from the hub 116 of the upper pivoting apparatus 28 and allow the upper arm 66 of the frame 22 to pivot to its desired position.

It will be understood that each of the elements described above, or two or more together, may also find a useful application in other types of constructions differing from the types described above.

While the invention has been illustrated and described as embodied in a collapsible machine for exercising the whole body of an exerciser in a wheelchair, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A collapsible exercising machine for use by an exerciser seated in a wheelchair, comprising:

a) a substantially U-shaped flat, thin base for placement on a generally horizontal surface, said base having a lowermost surface for placement on said generally horizontal surface, an uppermost surface that is disposed above, and parallel to, said lowermost surfaces and a front edge, said base having a pair of legs extending rearwardly from said front edge, each of said legs being divided laterally to form a front leg segment and a rear leg segment, said front and rear leg segments of each said leg being foldably joined together to allow said legs to be folded for easy storage and transport;

b) a frame pivotally mounted to said base, said frame being comprised of an upper arm and a lower arm, said lower arm being pivotally attached at its lower end to said base, and said upper arm being pivotally attached at its lower end to the upper end of said lower arm;

c) a pair of rotatable crank arms for gripping by the hands of said exerciser rotatably attached to said upper arm;

d) a pair of rotatable foot pedals for supporting the feet of said exerciser rotatably attached to said lower arm; and e) a drive train rotatable mounted to said frame for communicating said pair of rotatable crank arms with said pair of rotatable foot pedals.

2. The machine as defined in claim 1 wherein said lower arm of said frame is hollow and rectangular-parallelepiped-shaped, and has an approximate midpoint with a throughbore extending laterally therethrough, a lowermost end that is pivotally mounted to said front cross member of said base, at its midpoint, and a uppermost end with a throughbore extending laterally therethrough.

3. The machine as defined in claim 2 wherein said upper arm of said frame is hollow and rectangular-parallelepiped-shaped, and has a lowermost end with a throughbore extending laterally therethrough and a lowermost free end, and further has an uppermost end with a throughbore extending laterally therethrough; said lowermost end of said upper arm of said frame is pivotally mounted, side by side, to said uppermost end of said lower arm of said frame so as to fold relative thereto.

4. The machine as defined in claim 3, wherein said drive train comprises an upper crankshaft that comprises an upper crank axle that extends rotatably through said throughbore in said uppermost end of said upper arm of said frame for rotative motion relative thereto.

5. The machine as defined in claim 4, wherein said upper crankshaft of said drive train further comprises an upper sprocket gear that is disposed in said upper arm of said frame, and is mounted on said upper crank axle of said upper crankshaft of said drive train for rotation therewith.

6. The machine as defined in claim 4, wherein said crank arms are offsetingly disposed on said upper crank axle of said upper crankshaft of said drive train, at its ends, for rotation therewith and for gripping by the hands of the exerciser.

7. The machine as defined in claim 5, wherein said drive train further comprises an intermediate axle that extends rotatably through said throughbore in said uppermost end of said lower arm of said frame and rotatably through said throughbore in said lowermost end of said upper arm of said frame.

8. The machine as defined in claim 7, wherein said drive train further comprises a pair of intermediate sprocket gears that are mounted on said intermediate axle of said drive train for rotation therewith, with one gear thereof disposed in said uppermost end of said lower arm of said frame, and with the other gear thereof disposed in said lowermost end of said upper arm of said frame.

9. The machine as defined in claim 8, wherein said drive train further comprises a lower crankshaft that comprises a lower crank axle that extends rotatably through said throughbore in said approximate midpoint of said lower arm of said frame for rotation relative thereto.

10. The machine as defined in claim 9, wherein said lower crankshaft of said drive train further comprises a lower sprocket gear that is disposed in said lower arm of said frame, and is mounted on said lower crank axle of said lower crankshaft of said drive train for rotation therewith.

11. The machine as defined in claim 9, wherein said lower crankshaft of said drive train further comprises a pair of lower crank arms that are offsetingly disposed on said lower crank axle of said lower crankshaft of said drive train, at its ends, for rotation therewith.

12. The machine as defined in claim 9, wherein said lower crankshaft of said drive train further comprises a pair of flywheels that are disposed on said lower crank axle of said lower crankshaft of said drive train for rotation therewith, between said lower arm of said frame and said pair of lower crank arms of said lower crankshaft of said drive train for adding momentum.

13. The machine as defined in claim 8, wherein said drive train further comprises an upper sprocket chain that is disposed in said upper arm of said frame, and engages said upper sprocket gear of said upper crankshaft of said drive train and engages said other sprocket gear of said pair of intermediate sprocket gears of said drive train for rotation therewith.

14. The machine as defined in claim 10, wherein said drive train further comprises a lower sprocket chain that is disposed in said lower arm of said frame, and engages said one sprocket gear of said pair of intermediate sprocket gears of said drive train and engages said lower sprocket gear of said lower crankshaft of said drive train for rotation therewith so as to allow one crankshaft to rotate when the other crankshaft is rotated allowing said collapsible machine for exercising the whole body of an exerciser in a wheelchair to be used by the exerciser with use of only one of arms and legs.

15. The machine as defined in claim 11, wherein said drive train further comprises a pair of foot pedals that are substantially L-shaped in vertical profile so as to prevent the ankles of the exerciser from unwanted movement when the legs of the exerciser lack the ability to act.

16. The machine as defined in claim 15, wherein each pedal of said pair of foot pedals of said drive train comprises a bottom portion for supporting a foot of the exerciser, and is flat and pivotally mounted to a respective arm of said pair of lower crank arms of said lower crankshaft of said drive train.

17. The machine as defined in claim 16, wherein each pedal of said pair of foot pedals of said drive train further comprises a rear portion for supporting a lower leg of the exerciser, and is substantially semi-cylindrically-shaped and extends upwardly from said bottom portion of a respective pedal of said pair of foot pedals of said drive train, at its rear edge.

18. The machine as defined in claim 12, wherein said drive train further comprises a tensioner for adjusting resistance on said lower crankshaft, and is disposed on said lower arm of said frame, on one side thereof, and at its approximate midpoint.

19. The machine as defined in claim 18, wherein said tensioner of said drive train comprises a block that is internally threaded and fixedly attached to said approximate midpoint of said one side of said lower arm of said frame, and extends longitudinally therealong.

20. The machine as defined in claim 19, wherein said tensioner of said drive train further comprises a threaded bolt that threadably engages through said block of said tensioner of said drive train, with its free end being in selective contact with one flywheel of said pair of flywheels of said drive train, and with its head providing a gripping surface for its rotation.

21. The machine as defined in claim 2, wherein said lower pivoting apparatus comprises said lowermost end of said lower arm of said frame having a throughbore that extends laterally therethrough.

22. The machine as defined in claim 21, wherein said lower pivoting apparatus further comprises a pair of pivot plates that are flat, spaced-apart, parallel, and have throughbores extending laterally aligned therethrough; said pair of pivot plates of said lower pivoting apparatus extend perpendicularly upwardly from said uppermost surface of said body of said base, on said front cross member of said base, at its midpoint, and straddle said lowermost end of said lower arm of said frame.

23. The machine as defined in claim 22, wherein said lower pivoting apparatus further comprises a threaded bolt that extends through said throughbores in said pair of pivot plates of said lower pivoting apparatus, through said throughbore in said lowermost end of said lower arm of said frame, and threadably engages a threaded throughbore in a handle so by tightening said handle of said lower pivoting apparatus, said pair of pivot plates compress against said lowermost end of said lower arm of said frame and maintain it in its desired position, and by loosening said handle of said lower pivoting apparatus, said pair of pivot plates release from said lowermost end of said lower arm of said frame and allow it to pivot to its desired position.

24. The machine as defined in claim 3, wherein said upper pivoting apparatus comprises said lowermost end of said upper arm of said frame having a throughslot that extends axially from said throughbore in said lowermost end of said upper arm of said frame to said lowermost free end of said lowermost end of said lower arm of said frame, on both sides of said lowermost end of said lower arm of said frame.

25. The machine as defined in claim 24, wherein said upper pivoting apparatus further comprises said lowermost end of said upper arm of said frame having another throughbore that extends therethrough, from front to back.

26. The machine as defined in claim 25, wherein said upper pivoting apparatus further comprises a hub that extends pivotally through said throughbore in said lowermost end of said upper arm of said frame and fixedly through said throughbore in said uppermost end of said lower arm of said frame for pivoting therewith.

27. The machine as defined in claim 2, wherein said upper pivoting apparatus further comprises a threaded bolt that extends through said another throughbore in said lowermost end of said upper arm of said frame and threadably engages a threaded throughbore in a handle so by tightening said handle of said upper pivoting apparatus, said throughslot in both sides of said lowermost end of said upper arm of said frame compress causing said throughbore in said lowermost end of said upper arm of said frame to compress against said hub of said upper pivoting apparatus and maintain said upper arm of said frame in its desired position, and by loosening said handle of said upper pivoting apparatus, said throughslot in both sides of said lowermost end of said upper arm of said frame open causing said throughbore in said lowermost end of said upper arm of said frame to release from said hub of said upper pivoting apparatus and allow said upper arm of said frame to pivot to its desired position.

28. The machine of claim 1 wherein the said legs of said base are adapted to receive the wheels of said wheelchair.

29. The machine of claim 1 wherein at least one rear cross member extends between said legs to provide rigidity to said base.

30. The machine of claim 1 wherein a pair of rear cross members extend between said legs, the first of said pair of cross members extending between said front leg segments and the second of said pair of cross members extending between said rear leg segments.

31. The machine of claim 30 wherein said pair of rear cross members are adjacent each other.

32. The machine of claim 1 wherein said each of said legs are comprised of upper and lower surfaces, front and rear edges, an inner and outer longitudinal sides extending between said front and rear edges, said inner and outer longitudinal sides being spaced-apart and substantially parallel to each other.

33. The machine of claim 32 wherein said front and rear leg segments of both said legs have an inner side rail disposed on the upper surface thereof, said inner side rails extending longitudinally along substantially the entire length of the inner longitudinal sides of said leg segments.

34. The machine of claim 33 wherein said front and rear leg segments of both said legs have an outer side rail disposed on the upper surface thereof, said outer side rails extending longitudinally along substantially the entire length of the outer longitudinal sides of said leg segments.

35. The machine of claim 34 wherein said outer side rails of adjoining leg segments are hingedly attached by a hinge located on their upper surfaces in a manner that allows said rear leg segments to be folded upwardly.

36. The machine of claim 34 wherein said inner side rails, said outer side rails, and said upper surfaces of said legs form guide ramps on said legs adapted to receive the wheels of a wheelchair.

37. The machine of claim 32 wherein said front cross member is disposed on the upper surfaces of said front leg segments and extends laterally between said front leg segments adjacent the front edges thereof.

* * * * *